United States Patent [19]

Gaynor

[11] 3,998,434

[45] Dec. 21, 1976

[54] PHOTOGRAPHIC TRAY ROCKER

[76] Inventor: Edwin S. Gaynor, 688 Hulls Farm Road, Southport, Conn. 06490

[22] Filed: Feb. 21, 1975

[21] Appl. No.: 551,706

[52] U.S. Cl. ..... 259/73; 354/328; 354/335

[51] Int. Cl.[2] ..... B01F 13/00; G03D 3/04

[58] Field of Search ..... 354/297, 324, 327, 328, 354/329, 330, 331, 333, 335, 340, 343; 259/72, 73, 75, 54, 55

[56] References Cited

UNITED STATES PATENTS

| | | | |
|---|---|---|---|
| 766,483 | 8/1904 | Wolfe | 259/75 |
| 1,352,330 | 9/1920 | Tyler | 259/75 |
| 2,494,866 | 1/1950 | Fressola | 259/73 |
| 2,877,700 | 3/1959 | Keller | 354/327 X |
| 3,478,666 | 11/1969 | Bishop | 354/327 X |

FOREIGN PATENTS OR APPLICATIONS

| | | | |
|---|---|---|---|
| 894,502 | 10/1953 | Germany | 354/327 |
| 317,630 | 12/1919 | Germany | 259/73 |

*Primary Examiner*—Fred L. Braun

*Attorney, Agent, or Firm*—Kenyon & Kenyon Reilly Carr & Chapin

[57] ABSTRACT

Apparatus for rocking photographic developing trays includes an open frame for holding a plurality of rectangular trays of preselected size nested within the frame. Rocker tabs attached to each end support the frame for rocking motion on a suitable flat surface. A separate base member includes a pivot for positioning the base with respect to a pivot point at the center of a transverse brace joining opposite sides of the frame. An electrical drive motor mounted on the base member is eccentrically coupled to the frame for rocking the frame on the rocker tabs at predetermined amplitude and frequency. The frame is assembled from flat metal strips, two U-shaped ends joined by two straight center strips; so that the frame is stiff in bending to support the weight of the trays but can warp to provide a twisting rocking motion for improved mixing of the tray contents. Transverse tray racks can be laid across the frame to support trays smaller than the preselected size for processing small print batches.

12 Claims, 3 Drawing Figures

PHOTOGRAPHIC TRAY ROCKER

BACKGROUND OF THE INVENTION

This invention relates to photographic developing apparatus and particularly to apparatus for rocking photographic developing trays.

Processing of black and white photographic prints requires three solutions: developer, stop bath, and hypo or fixer. The typical amateur or professional photographer who processes his own prints uses three rectangular flat bottom developing trays placed in a row in a darkroom sink, with a different one of the solutions in each tray. After exposure, the prints are placed in the developer solution first and the tray agitated so that the developer flows back and forth from one end of the tray to the other, thereby continually washing fresh solution over the prints. After a developing period of approximately 2 minutes, the prints are transferred to the tray containing the stop bath and agitated for about 20 seconds to stop further development of the print. The prints are then placed in the last tray of hypo, and this tray is agitated for approximately 6–10 minutes to fix the print.

There are four standard sizes of photographic developing trays corresponding to print sizes of 5 by 7 inches, 8 by 10 inches, 11 by 14 inches and 16 by 20 inches, the actual dimensions of each tray being about two inches larger than the nominal dimensions. The choice between sizes will be dictated by the number and dimensions of the prints to be processed.

Commonly the tray agitation is done by hand, but this becomes tiresome, particularly during the fixing cycle. In addition, it is difficult to agitate the trays while simultaneously checking the progress of the development and moving the prints from one bath to the next.

Various devices have been suggested for automating the tray rocking process. One such device, shown in U.S. Pat. No. 3,478,666 to L. H. Bishop, includes a tray platform supported on a housing for four-way rocking motion about intersecting axes lying in a common plane. The four-way rocking motion is achieved by a motor-driven arm mounted in the housing underneath the platform. The arm rotates about a vertical axis and carries a drive bearing at its outer end for engaging four cams attached to the underside of the platform at angular spacings of 90°. A similar tray rocking apparatus, in U.S. Pat. No. 2,494,866 to A. J. Fressola, comprises a tray platform oscillated about fixed horizontal intersecting axes by means of a pair of cams mounted on right-angled shafts coupled by a pair of bevel gears and driven by a single motor.

In still another known arrangement, a rectangular tray platform is positioned by means of spaced parallel ribs extending from its underside, for pivoting motion about its longitudinal axis on the edge of a long metal strip set upright in a heavy wooden base. An electric motor drive is connected through a crank arrangement to one side of the platform for oscillating it on the knife-edge support strip.

The above platform-type of tray rockers hold only one tray, or two at the most; so that it is necessary either to shift trays on and off the platform or to purchase two or more rocking machines because a platform large enough to accommodate three of the largest size trays would be impractically large, heavy, and expensive.

Shifting single trays of successive processing solutions off and on a small rocker platform not only is a tedious chore that tends to cause spills and mess but also may result in spoiled prints because of delays in moving the prints from one bath to the next. Furthermore, it is desirable to rock all three trays continuously so that prints can be processed at a steady rate rather than in batches of a few at a time through the entire process.

SUMMARY OF THE INVENTION

The objects of the present invention, therefore, are to provide a lightweight apparatus for simultaneously rocking any desired number of photographic developing trays of any of the standard sizes, the apparatus being capable of easy and quick disassembly for cleaning, or to form a compact package for shipment or storage, and being inexpensive enough to be affordable by amateur photographers yet sturdy enough to satisfy the requirements of professionals.

These and other objects are met by an improved tray rocking apparatus having as its principal feature a lightweight open rectangular frame. The internal dimensions of the frame are chosen to accommodate a predetermined number of rectangular photographic developing trays of preselected size nested within the frame. Preferably, the spacing between the sides of the frame accommodates the length of the nominal 11 × 14 inch tray; the 16 × 20 inch size is rarely used and can rest on top of the frame when needed. The frame can be converted easily to hold smaller sizes by means of transverse tray racks resting on the sides, two racks supporting each tray. The frame preferably holds at least three 11 × 14 trays side by side, or four trays if a hypo rinse is desired.

Means for supporting the frame above a flat surface, such as the bottom of a darkroom sink, are provided near the midpoint of each end of the frame for permitting rocking motion of the frame. In a preferred embodiment the support means comprises a center tab extending from the underside of each end of the frame, each tab having an arcuate bottom edge to act as a rocker for the frame.

An electric motor drive unit is mounted on a separate base and has an eccentric output member of predetermined, preferably selectable, eccentricity that is coupled to the frame for rocking the frame on the support means at a predetermined amplitide and frequency. The base is located with reference to the frame by means at a predetermined amplitude and frequency. the center of a transverse member joining the opposite sides of the frame. Preferably the transverse member is located midway between the ends of the frame; so that the base pivot serves also to support the center of the frame against sagging from the weight of the trays.

The output speed of the motor drive unit is chosen to produce a frame oscillating frequency near the natural sloshing frequency of the processing liquids in the trays. For 11 × 14 size trays, best results are obtained with drive unit output speeds of 20–30 revolutions per minute (rpm). At the same time, the frame oscillation amplitude must be kept below the point at which spilling over the ends of the trays will occur. This point normally is not reached if the eccentricity of the output member is limited to 1 inch or less.

Additional features and advantages of the invention are disclosed and illustrated in the following description of the preferred embodiment, in conjunction with the accompanying drawings.

DESCRIPTION OF THE PREFERRED EMBODIMENT

Figure 1:
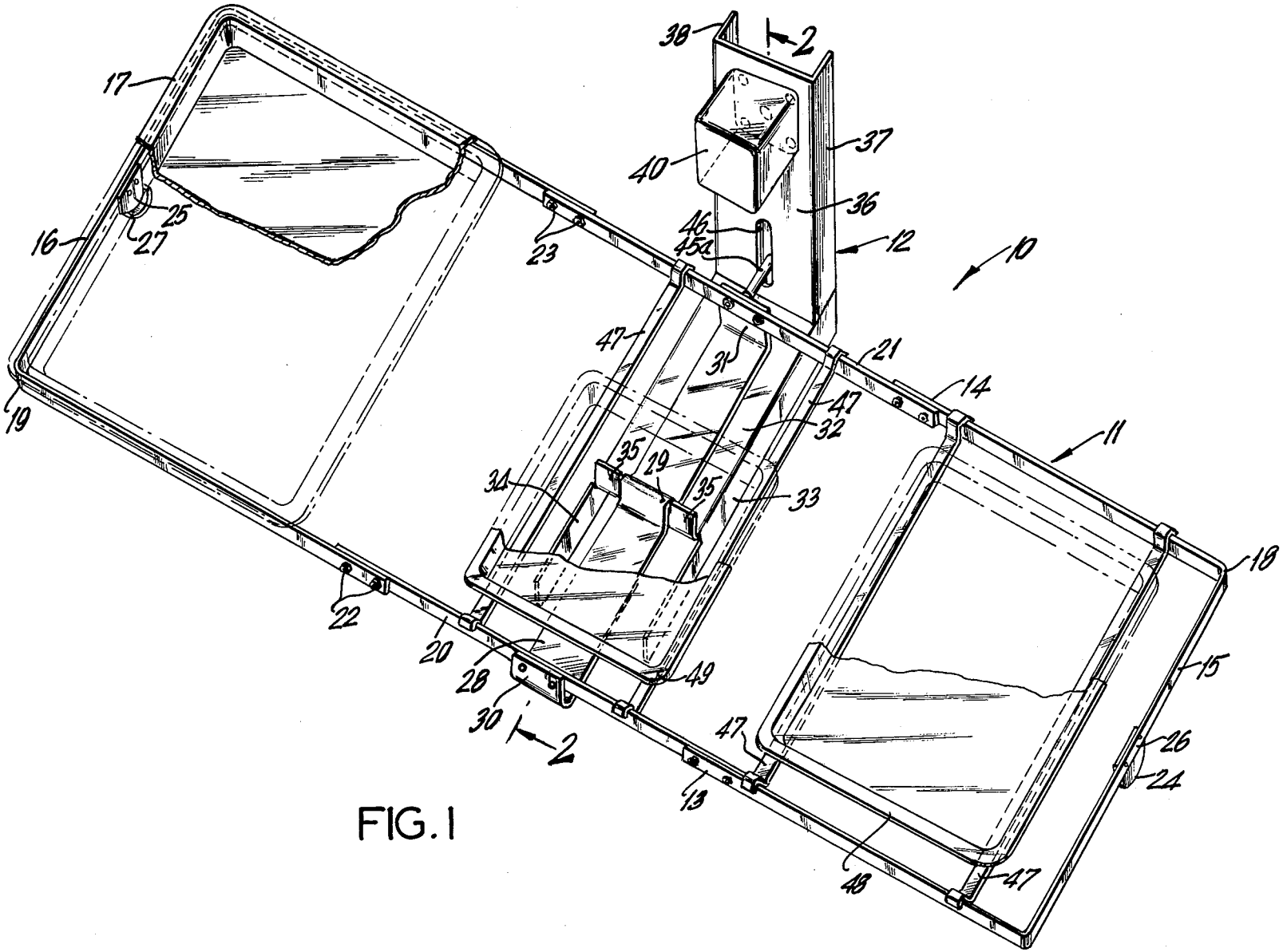
FIG. 1 is a perspective view of the assembled open-frame tray rocker arranged for three sizes of trays, shown partly in dashed lines.

Referring to FIG. 1, a tray rocking apparatus 10 includes an open, rectangular frame 11 and a separate supporting base 12. Frame 11 is formed with parallel sides 13, 14 and parallel ends 15, 16, the spacing between the sides chosen to accommodate a rectangular photographic developing tray 17 (shown partly in dashed lines) of preselected size nested with the lip of the tray resting on the sides of the frame. The side spacing is preferably slightly greater than the length of the size 11 by 14 inch tray, although any other dimension corresponding to a commonly used tray size can be chosen, as desired.

The open frame can be made of any suitable materials including metal, wood, or high strength plastic, and it can be made in various configurations. Particular advantages result, however, from the construction illustrated in the drawing in which the frame is assembled from a pair of elongated metal strips 18, 19, each bent into the form of a flat-bottomed U, and a pair of straight metal strips 20, 21. The base of each U-shaped piece forms a corresponding end 15, 16 of the frame, while the free ends of each U are joined to corresponding ends of the straight pieces 20 and 21 by any suitable fastening means, such as small machine screws 22 with nuts 23, to form the sides of the frame.

By making the frame in four pieces, as above, it will fit disassembled into the smallest package possible for so few pieces yet will expand when assembled to hold the desired number of trays. For example, the lengths of the base portion and both legs of the U-shaped pieces 15, 16 and the lengths of the straight side pieces are all about the same in the embodiment of FIG. 1. This allows the entire apparatus to fit in an approximately square box when disassembled. If the nominal width of the frame is selected as 16 inches, then the length of the assembled frame will be almost 4 feet. This is long enough to accommodate three of the nominally 11 × 14 inch trays. The frame length can easily be extended merely by substituting longer side pieces 20 and 21; so that four trays can be nested side by side if a hypo rinse is desired.

For the optimum combination of strength with light weight, corrosion resistance, and economy, the frame pieces are formed from aluminum strips, although carbon or stainless steel can also be used. A frame of the size indicated above has been constructed from strips 3/32 inch thick by ½ inch wide, for a ratio of width to thickness of about 5. This ratio combines excellent vertical stiffness with a degree of lateral flexibility that permits moderate warping of the frame to produce an operational advantage that will be described below.

Frame 11 incorporates means for supporting the frame above a flat surface for rocking movement such as rocker tabs 24 and 25 attached near the midpoint of each end 15 and 16, respectively. Each rocker tab is attached to the corresponding frame end by rivets 26 or other suitable fastening means and has an arcuate bottom edge to provide rolling contact with the supporting surface. To reduce the tendency to wear a groove in the surface, the rocker contact area can be increased by providing an arcuate rib or flange 27 on the bottom edge of each tab.

In addition to the rocker tabs at each end, the frame is braced and supported in the center by a transverse member 28 formed from an elongated piece of 3/32 inch aluminum sheet. Member 28 has an upward crimp 29 in the center that serves as a pivot point and upwardy turned ends 30, 31 that are riveted or otherwise fastened to side pieces 20 and 21 of the frame.

Separate support base 12 is formed preferably from a single sheet of aluminum, also 3/32 inch thick, into an L-shaped member having a horizontal leg 32, with downturned longitudinal flanges 33, 34 and upturned transverse flange 35, and a vertical leg 36 with rearward turned longitudinal flanges 37, 38. Up-turned flange 35 serves as a knife-edge pivot for engagement with the pivot point created by crimp 29 in the transverse brace member 28 and accomplishes the dual functions of supporting the center of the frame from sagging under the weight of liquid-filled trays and of locating the separate support base with respect to the frame. This latter function, in turn, allows the frame to be coupled to the output shaft 39 of an electric motor drive unit 40 mounted at the top of vertical leg 36, as shown more clearly in FIGS. 2 and 3.

Figure 2:
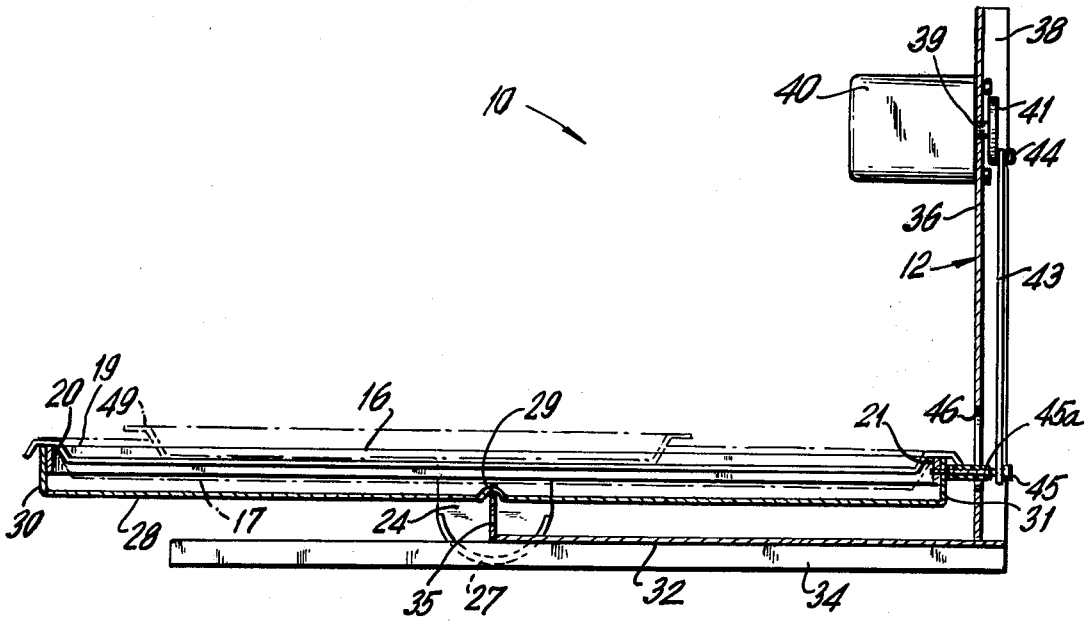
FIG. 2 is a side elevation section view of the assembly taken along line 2—2 of FIG. 1.
Figure 3:
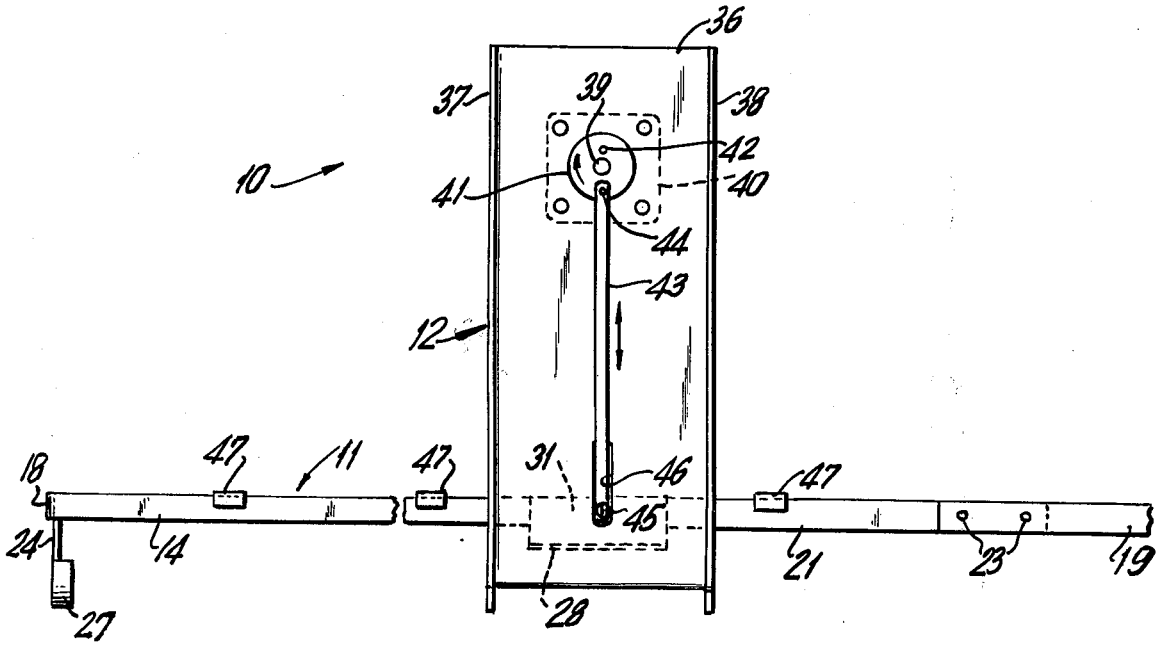
FIG. 3 is a rear elevation view of the assembly of FIG. 1.

Referring to FIGS. 2 and 3, an eccentric output member in the form of a disc 41 is mounted on the end of output shaft 39 for rotation by the shaft. At least one eccentric hole 42 is drilled in the disc for rotatably mounting the upper end of a connecting link 43 by means of a crank pin 44 or similar device. A number of holes 42 of varying eccentricity can be provided in angularly spaced relation in disc 41 to provide a wide range for adjusting the amplitude of frame oscillations. The lower end of connecting link 43 is coupled to frame 11 by a screw 45 and plastic bushing **45*a* passing through a vertical slot 46 in vertical leg 36. Thus, rotation of disc 41 on output shaft 39 causes vertical reciprocation of connecting link 43, and that motion is transformed into angular oscillation of frame 11 on rocker tabs 24, 25 and on pivot 35.**

To set up the tray rocking apparatus for operation, the frame is first assembled by fastening the four pieces 18, 19, 20 and 21 together, if they are disassembled. It should be noted here that the assembled frame is very light and can easily be hung against a wall out of the way when not in use to save the time of assembly and disassembly before and after each use. Since the rocker tabs and transverse brace member are preferably attached by rivets or other permanent fasteners, the frame is completely assembled after the above fastening step.

Next, the frame is positioned with pivot point 29 engaging pivot 35 and arm 45 extending through slot 46 in the vertical leg of support base 12. The end of arm 45 is then pivotally connected to the lower end of connecting link 43 by a pin, ball and socket, or other conventional means.

Partially filled trays of processing solutions are then placed on the frame. For illustrative purposes, three different sizes of trays are indicated by dashed lines in FIG. 1. Because the frame is sized to nest only the larger size of developing tray, the smaller trays are supported on transverse tray racks 47. Each tray rack is formed from the same ½ inch by 3/32 inch aluminum strip material as the frame and includes an elongated body portion with a length equal to the distance between the sides of the frame and offset end portions for resting on the sides of the frame. These tray racks are easily laid across the frame at any longitudinal position, depending on the size and location of the tray to be supported.

In FIG. 1, a medium size tray 48 (8 × 10 inches) is placed on two racks at the right hand end of the frame, and a small tray 49 (5 × 7 inches) is placed on an additional two racks in the center of the frame. Although primarily an illustrative arrangement, this is also quite a practical one for processing a number of prints on a substantially continuous, instead of a batch, basis. This is true because the number of prints in any of the three trays under continuous processing conditions will be a function of the residence time in each bath.

For example, the times spent by each print in the developing and fixing trays are roughly four to six times and 20 to 30 times the period spent in the stop bath, respectively. Thus, the stop tray can be smaller than the developing tray, while the fixing tray should be larger. In FIG. 1, therefore, tray 48 would be the developing tray, tray 49 would hold the stop bath, and tray 17 would be the fixing tray.

After the trays are set on the frame, the motor drive unit will be turned on by a switch (not shown) mounted near the motor for easy accessibility and protection from splashing. The proper solutions are then poured into each tray, taking care that they do not slosh over the edges of the trays. If the back and forth motion of the liquid in the trays is too severe, the eccentricity of the drive unit output can be reduced by shifting crank pin 4 of connecting link 43 to a less eccentric hole 42. As mentioned previously, the maximum eccentricity should be no more than about 1 inch, and the speed of the motor drive output shaft should be in the range of about 20–30 rpm for best results.

Also mentioned previously was the advantage of having a certain amount of torsional flexibility in the frame as a result of using thin frame members in relation to their depth (e.g., having a ratio of depth to thickness of about 5). With a frame of this type, unbalanced forces, such as result from a heavier tray at one end than at the other, from slightly off-center mounting of the rocker tabs on the ends of the frame, or from off-center attachment of arm 45 on the side of the tray will tend to cause a twisting and untwisting movement of the frame superimposed on the basic rocking oscillation. This twisting motion, in turn, imposes a longitudinal component on the transverse sloshing movement of the liquid in the trays, thereby improving the mixing action and assuring that fresh solution is continuously supplied to all areas of each print.

The twisting action can be accentuated, if desired, by attaching rocking arm 45 at or near one end of the frame. In such case, a pivot point means could be substituted for the rocker tab at that end, which would then be supported on the transverse flange pivot of support base 12. Alternatively, each rocker tab can be purposely offset by a predetermined amount on opposite sides of the frame centerline to increase the frame twisting action.

From the foregoing description, it will be apparent that the open-frame tray rocker of the present invention provides numerous advantages and benefits, not only in minimizing cost, weight, and volume of the apparatus, but also in the flexibility of possible tray arrangements and the range of control over the mixing and agitating action. In addition, the open frame permits quick and easy cleanup of any spills underneath the apparatus without the need to remove the frame from the support base. Alternatively, the frame can be immersed in a temperature controlled bath, the open frame allowing free circulation of the bath around the trays while the motor at the top of the vertical leg is kept safe from shorting.

I claim:

1. Apparatus for rocking photographic developing trays comprising:

an open rectangular frame, having two parallel sides joined by two ends perpendicular thereto, the internal dimensions of the frame being adapted to accomodate a predetermined plurality of rectangular photographic developing trays of preselected size nested within the frame;

means for supporting the frame above a flat surface near the midpoint of each end of the frame for rocking movement;

a transverse member joining the two sides of the frame and having a pivot point at the center of the member;

a separate base member adapted to rest on the flat surface and extend underneath the transverse member, the base member having a locating pivot for engaging the pivot point on the transverse member and locating the frame with respect to the base member;

an electric motor drive unit mounted on the base member and having an eccentric output member of predetermined eccentricity rotatable at a predetermined speed; and means for coupling the eccentric output member to the frame for rocking the frame on the support means at predetermined amplitude and frequency.

2. The apparatus of claim 1 wherein the frame comprises a pair of U-shaped end members, a pair of straight side members, and means for rigidly attaching the ends of the side members to free ends of the end members.

3. The apparatus of claim 1 wherein the frame comprises:

a pair of elongated metal strips each bent into the form of a flat-bottomed U, the base of each U-shaped strip forming one end of the frame and having a dimension corresponding to one dimension of a developing tray of the preselected size;

a pair of straight elongated metal side strips, each end of each side strip overlapping a corresponding free end of the U-shaped strips; and means for connecting the ends of the side strips to the corresponding ends of the U-shaped strips to form a rectangular frame having substantial resistance to bending perpendicular to the plane of the frame.

4. The apparatus of claim 3 in which the ratio of width to thickness of the end strips and side strips of the frame is approximately 5.

5. The apparatus of claim 1 further comprising a plurality of tray racks for supporting developing trays smaller than the preselected size on the frame, each tray rack having an elongated body portion with a length equal to the distance between the sides of the frame and offset end portions for resting on the sides of the frame with the body portion extending transversely across the frame.

6. The apparatus of claim 1 wherein the transverse member is located approximately midway between the ends of the frame.

7. The apparatus of claim 6 wherein the transverse member comprises a flat metal strip having an upward crimp in the center for defining the pivot point.

8. The apparatus of claim 1 wherein the eccentricity of the drive unit output member is a maximum of 1 inch.

9. The apparatus of claim 1 wherein the eccentric output member comprises a disc mounted concentrically on the electric motor drive shaft and having at least one eccentric hole therein, and the coupling means comprises a connecting link having one end connected to the disc for rotation about the axis of the eccentric hole and the other end connected to the side of the frame.

10. The apparatus of claim 9 wherein the disc has at least two eccentric holes spaced by different radial distances from the center of the disc for providing different selectable frame oscillation amplitudes.

11. The apparatus of claim 1 wherein the predetermined speed of the eccentric output member is between approximately 20 and 30 revolutions per minute.

12. The apparatus of claim 1 wherein the means for supporting the frame near the midpoint of each end comprises a tab extending from the underside of each end of the frame, each tab having an arcuate bottom edge to allow the frame to rock on the flat support surface.

* * * * *